US009437375B2

(12) United States Patent
Kuo

(10) Patent No.: US 9,437,375 B2
(45) Date of Patent: Sep. 6, 2016

(54) ELECTROMAGNETIC RELAY ASSEMBLY HAVING A SWITCH CONTROL UNIT

(71) Applicant: Excel Cell Electronic Co., Ltd., Taichung (TW)

(72) Inventor: Ming-Chang Kuo, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 14/665,152

(22) Filed: Mar. 23, 2015

(65) Prior Publication Data

US 2015/0279599 A1 Oct. 1, 2015

(30) Foreign Application Priority Data

Mar. 28, 2014 (TW) ..... 103111790 A

(51) Int. Cl.

| | |
|---|---|
| ***H01H 51/22*** | (2006.01) |
| ***H01H 9/24*** | (2006.01) |
| ***H01H 50/24*** | (2006.01) |
| ***H01H 50/64*** | (2006.01) |

(52) U.S. Cl.

CPC ..... *H01H 9/24* (2013.01); *H01H 50/24* (2013.01); *H01H 50/641* (2013.01); *H01H 50/647* (2013.01)

(58) Field of Classification Search

CPC ..... H01H 9/24; H01H 50/641; H01H 50/24; H01H 50/647

USPC ..... 335/168, 78

See application file for complete search history.

(56) References Cited

U.S. PATENT DOCUMENTS

| | | | | |
|---|---|---|---|---|
| 2,343,548 | A * | 3/1944 | Graves, Jr. | 335/168 |
| 6,545,575 | B1 * | 4/2003 | Hirabayashi et al. | 335/78 |
| 8,258,901 | B2 * | 9/2012 | Hao | 335/167 |

FOREIGN PATENT DOCUMENTS

| | | | |
|---|---|---|---|
| JP | H11176304 | A | 7/1999 |
| JP | 200123472 | A | 1/2001 |
| TW | 277758 | | 6/1996 |
| TW | 201019364 | A | 5/2010 |
| TW | M485492 | U | 9/2014 |

OTHER PUBLICATIONS

TW Search report in corresponding TW application No. 103111790 dated Nov. 25, 2015 (2 pages) [w/English translation].

* cited by examiner

*Primary Examiner* — Bernard Rojas
(74) *Attorney, Agent, or Firm* — Trop Pruner & Hu, P.C.

(57) ABSTRACT

An electromagnetic relay assembly includes a switching unit to push a sliding member and to place a locking portion of a locking member to lock the sliding member at a first position where the switching unit switches a first conductive plate and a second conductive plate to an electrically disconnected state. When a coil is energized, the sliding member is moved to a second position, and the locking portion of the locking member is placed to lock the sliding member in the second position where the switching unit is actuated by the sliding member to switch the first and second conductive plates to an electrically connected state.

8 Claims, 13 Drawing Sheets

ELECTROMAGNETIC RELAY ASSEMBLY HAVING A SWITCH CONTROL UNIT

CROSS-REFERENCE TO RELATED APPLICATION

This application claims priority of Taiwanese Application No. 103111790, filed on Mar. 28, 2014.

FIELD OF THE INVENTION

The invention relates to an electromagnetic relay assembly, and more particularly to an electromagnetic relay assembly operable to be mechanically positioned between a circuit making position and a circuit breaking position.

BACKGROUND OF THE INVENTION

A relay in general is an electrically operated switch capable of using a relatively small amount of electrical current to control an electronic device operated under a relatively large electrical current. As shown in FIGS. 1 and 2, a conventional magnetic relay includes an iron core 61, a coil 62 wound around the iron core 61, and an armature 63 detachably connected to the iron core 61. When the coil 62 is energized by a small electrical current that passes therethrough, a magnetic field is generated by the iron core 61 due to electromagnetic induction. The armature 63 is magnetically attracted by the iron core 61 to be positioned at a closed position (as shown in FIG. 1), thereby forming a circuit with a relatively large electrical current flowing therethrough. When the coil is de-energized, the electromagnetic induction disappears and the armature 63 is separated from the iron core 61 to reach an open position (as shown in FIG. 2) to break the circuit. However, in order to maintain the circuit at the closed position, the coil 62 has to be continuously energized by continuous application of the electrical current. As a result, a hazard to use of the conventional magnetic relay may arise due to massive production of waste heat and accelerated aging of peripheral elements caused by the waste heat.

In order to alleviate the aforesaid drawback, a conventional magnetic latching relay is proposed in Chinese Patent No. CN203038857U. The conventional magnetic latching relay includes a permanent magnet to attract and position an armature at a circuit making position. However, since the armature is positioned only by magnetic attraction of the permanent magnet, the armature may be displaced, arising in safety concerns due to undesired or unavoidable vibration of the relay.

SUMMARY OF THE INVENTION

Therefore, an object of the present invention is to provide an electromagnetic relay assembly that may alleviate at least one of the aforesaid drawbacks of the prior art.

According to the present invention, an electromagnetic relay assembly includes a housing, an electromagnetic unit, a switch assembly and a switch control unit.

The electromagnetic unit is disposed in the housing, and includes a magnetic spool, a coil wound on the magnetic spool, and an armature pivotally disposed on the magnetic spool.

The switch assembly includes first and second conductive plates mounted to the housing, and a switching unit disposed in the housing to switch the first and second conductive plates between electrically connected and disconnected states.

The switch control unit is disposed between the switching unit and the armature, and includes a sliding member that is slidably disposed in the housing to move between first and second positions, and a locking member. The sliding member is connected to the switching unit and has a guide groove formed with a first locking site and a second locking site. The locking member is movably mounted to the housing and has a locking portion that is inserted into the guide groove to move between the first and second locking sites.

The switching unit provides a resilient force to push the sliding member to the first position and to place the locking portion in the first locking site such that the sliding member is locked in the first position where the switching unit switches the first and second conductive plates to the electrically disconnected state.

When the coil is energized, the sliding member is moved by the armature to the second position, and the locking portion is placed in the second locking site such that the sliding member is locked in the second position where the switching unit is actuated by the sliding member to switch the first and second conductive plates to the electrically connected state.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
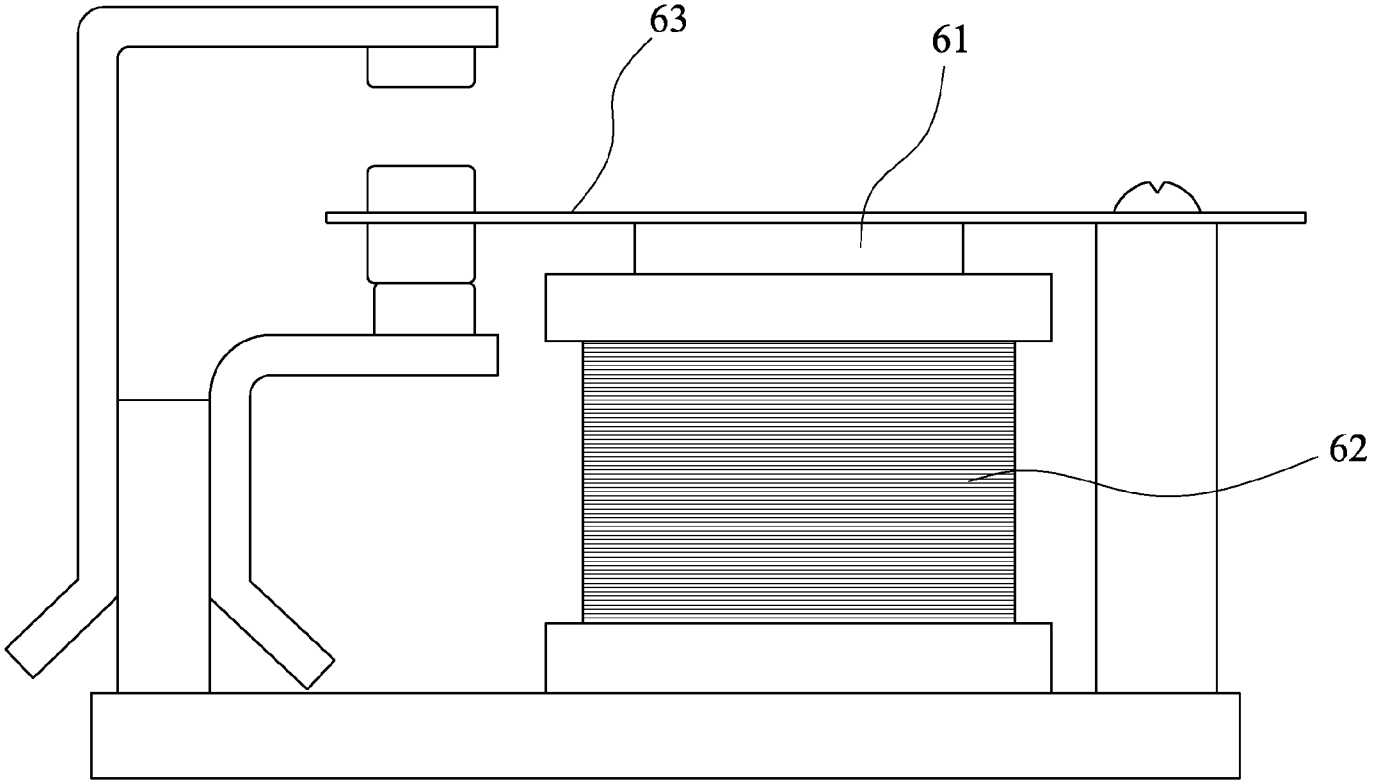
FIG.1 PRIOR ART
FIG. 1 is a side view of a conventional relay assembly in an energized state.
Figure 2:
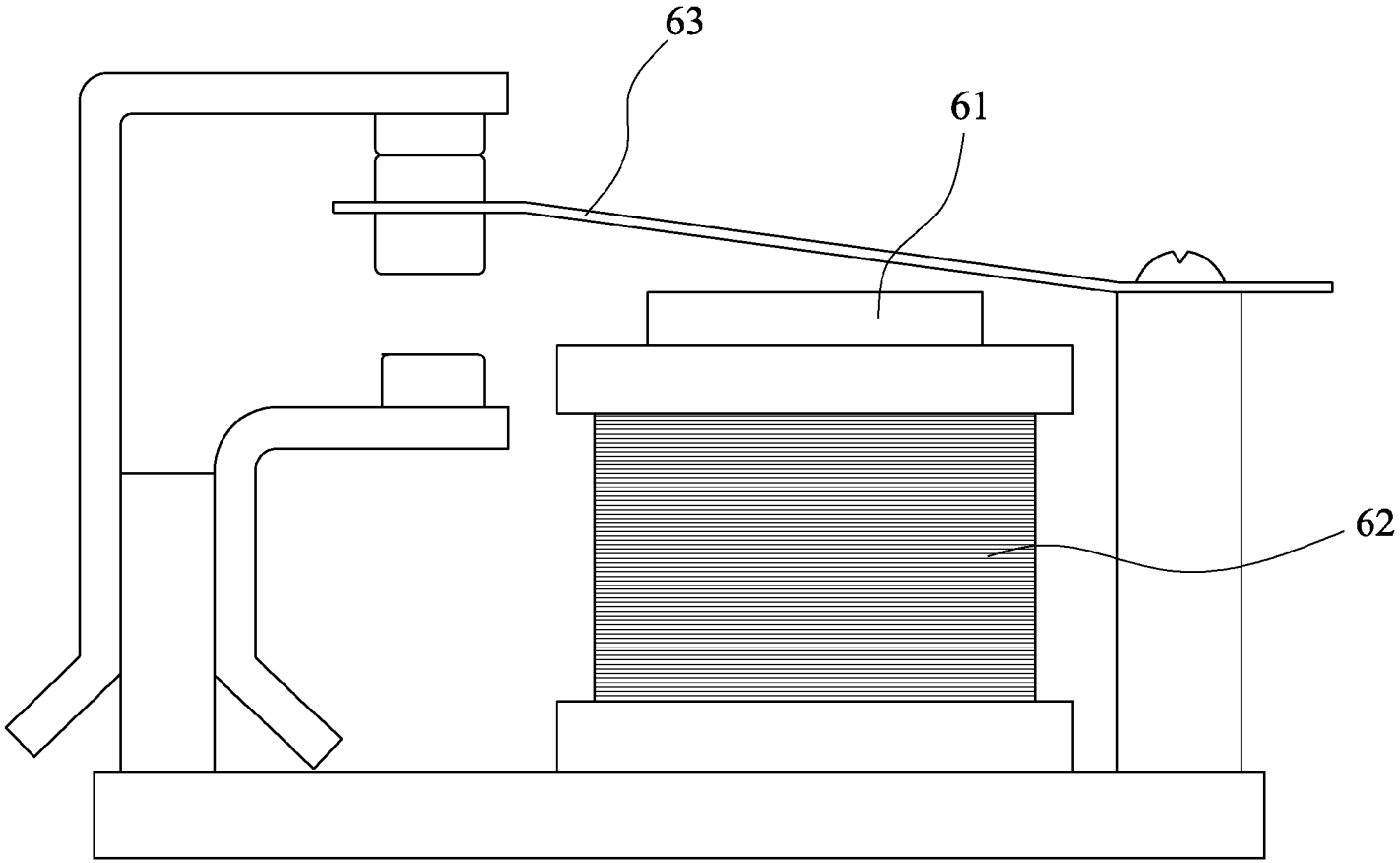
FIG.2 PRIOR ART
FIG. 2 is a side view of the conventional relay assembly in a de-energized state.

Before the present invention is described in greater detail, it should be noted that like elements are denoted by the same reference numerals throughout the disclosure.

Figure 3:
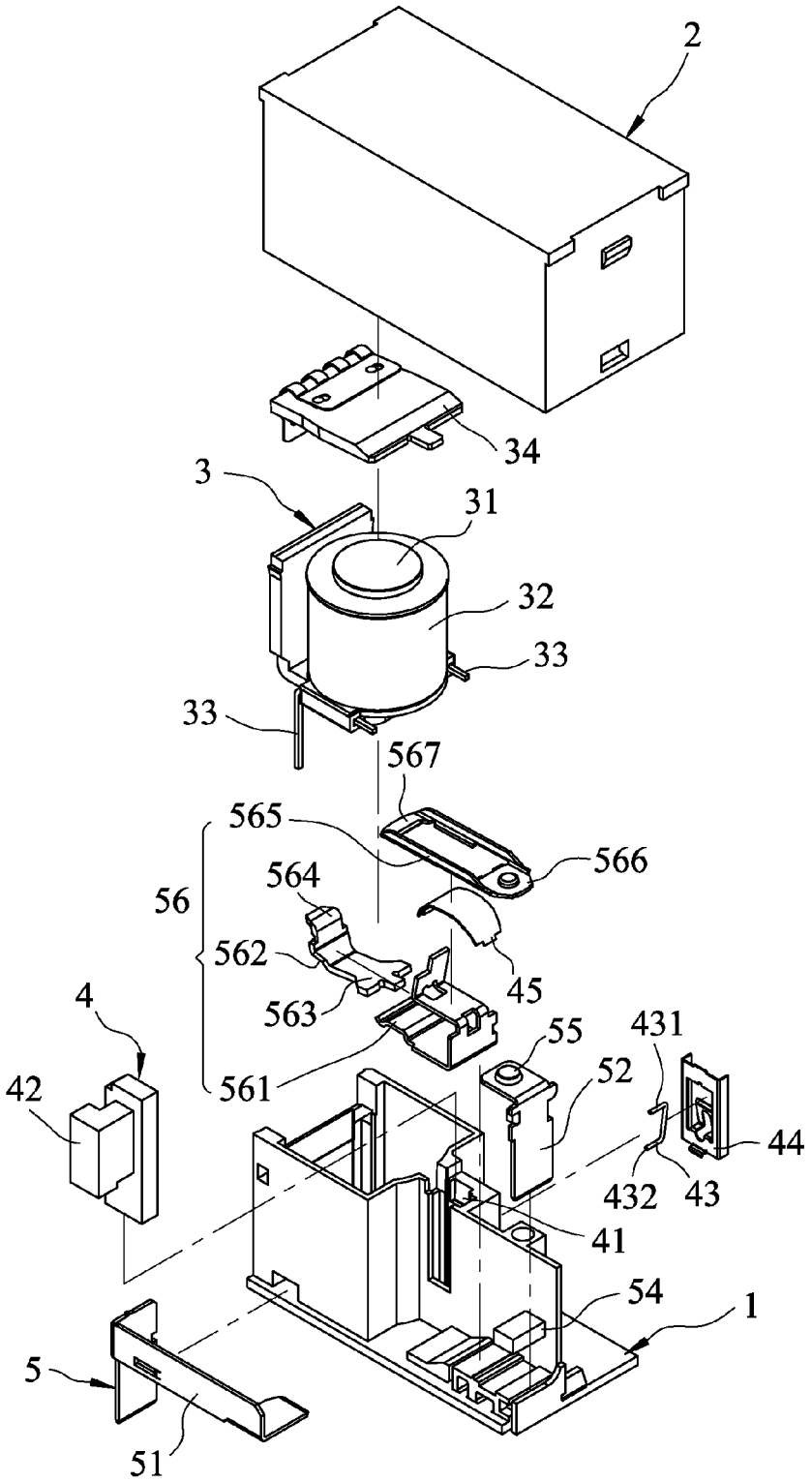
FIG. 3 is an exploded perspective view of the first embodiment of an electromagnetic relay assembly according to the present invention.
Figure 4:
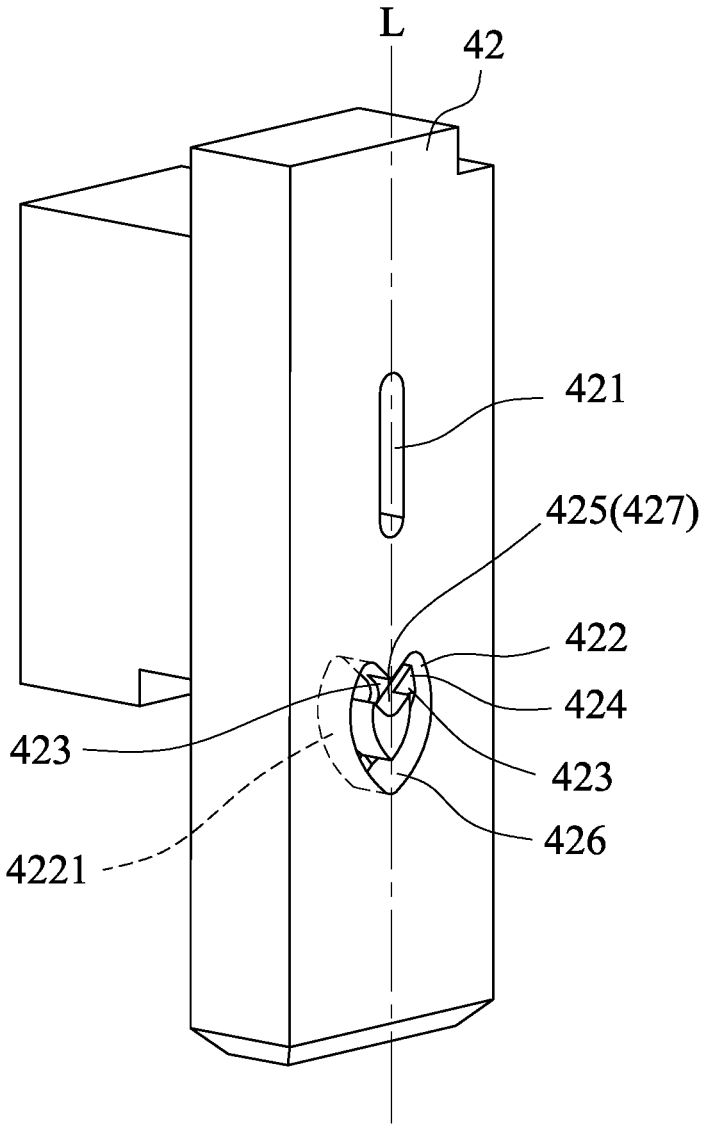
FIG. 4 is a schematic view of the first embodiment illustrating a sliding member of the electromagnetic relay assembly.
Figure 5:
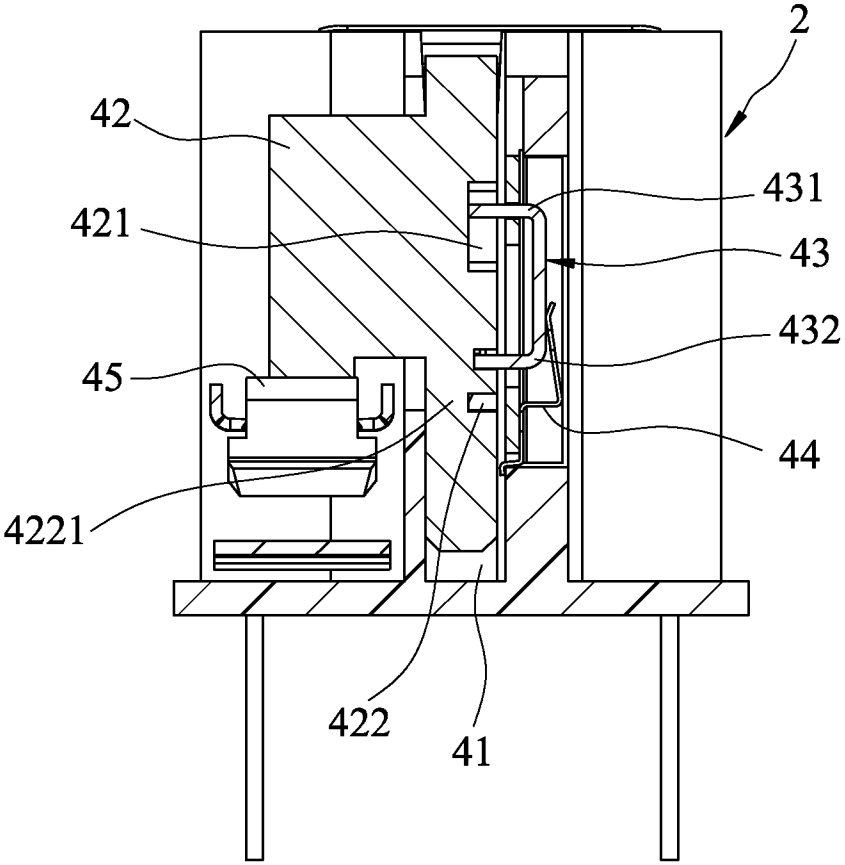
FIG. 5 is a sectional view of the first embodiment illustrating a connection relationship between a locking member and the sliding member of the electromagnetic relay assembly.

Referring to FIGS. 3 to 5, the first embodiment of an electromagnetic relay assembly according to the present invention is illustrated. The electromagnetic relay assembly includes a housing, an electromagnetic unit 3, a switch control unit 4 and a switch assembly 5.

The housing has a housing base 1 and a housing cover 2 detachably covering the housing base 1.

The electromagnetic unit 3 is disposed in the housing and includes a magnetic spool 31, a coil 32 wound on the magnetic spool 31, and an armature 34 pivotally disposed on the magnetic spool 31. In the first embodiment, the electromagnetic unit 3 further includes two terminals 33 electrically coupled to the coil 32 for receiving an external current signal. In this embodiment, the electromagnetic unit 3 is mounted on the housing base 1. When the coil 32 is electrified or energized, the magnetic spool 31 is excited to generate a magnetic field such that the armature 34 is magnetically attracted by the magnetic spool 31.

In the first embodiment, the switch control unit 4 is disposed between the switching unit 5 and the armature 34, and includes a sliding groove 41, a sliding member 42 slidably disposed in the housing, a locking member 43 and a retaining plate 44.

The sliding groove 41 is formed in the housing base 1. In this embodiment, the sliding groove 41 is disposed parallel to an axial direction of the magnetic spool 31.

Figure 6:
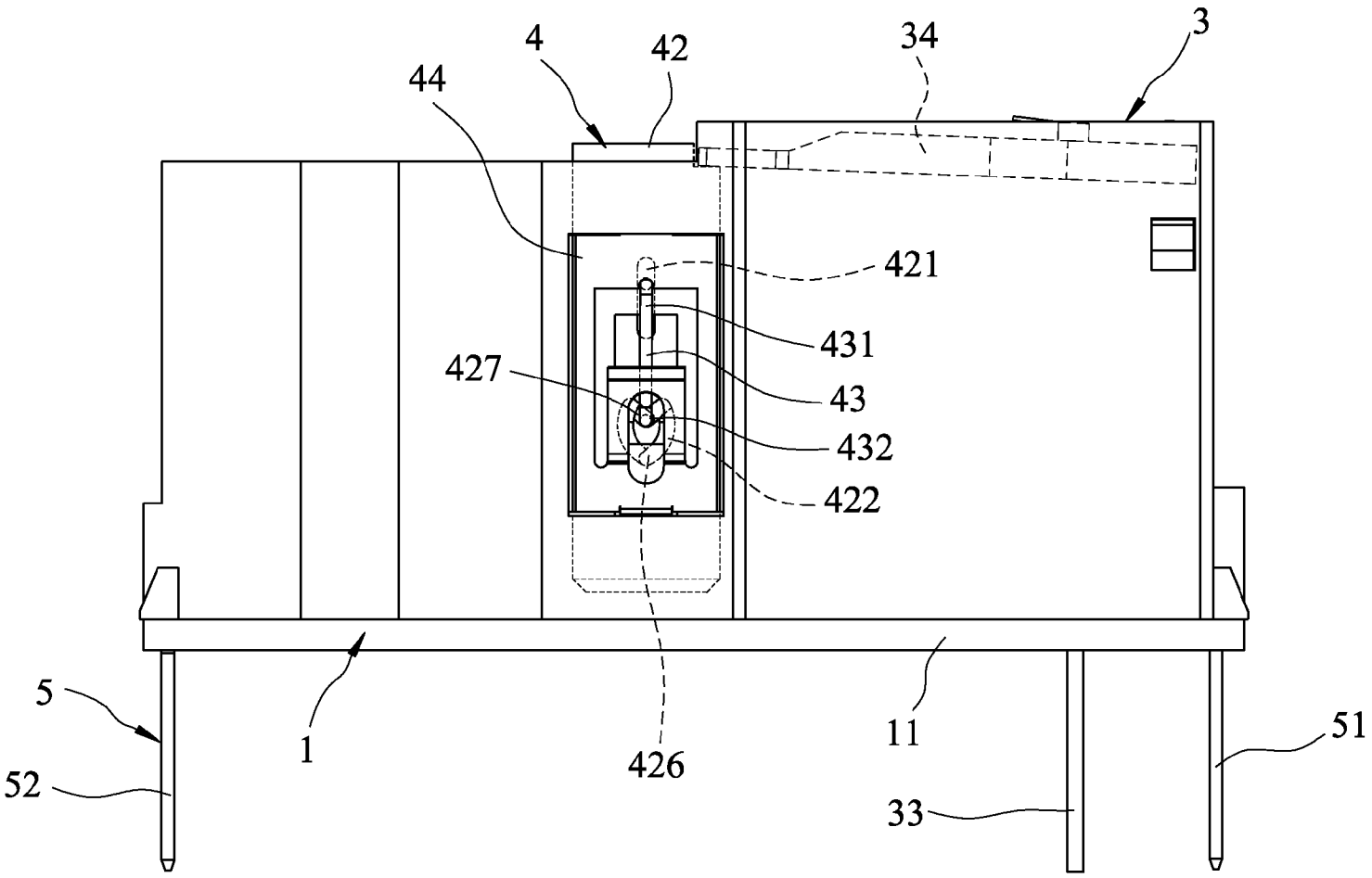
FIG. 6 is a rear view of the first embodiment.

Referring to FIGS. 4 to 6, the sliding member 42 is slidably disposed in the sliding groove 41 to be movable between first and second positions and is connectable to the armature 34. The sliding member 42 includes a guide groove 422 that is formed with a first locking site 426 and a second locking site 427. In this embodiment, the sliding member 42 is formed with an elongate opening 421 that is spaced apart from the guide groove 422. The sliding member 42 may be made of an insulating plastic material to avoid a short circuit or an electrical discharge caused by friction during transport.

The guide groove 422 is annular and has a groove wall 4221 opposite to an opening of the guide groove 422. The groove wall 4221 is formed with a plurality of inclined tooth-like portions 423 that are arranged annularly. In this embodiment, the guide groove 422 has an outer profile substantially conforming to a heart shape. Alternatively, the guide groove 422 may be configured to have other shapes, such as a lightning shape or a triangle shape.

In the first embodiment, each of the inclined tooth-like portions 423 has a slanting surface 424 and a shoulder surface 425 adjoining the slanting surface 424 of an adjacent one of the inclined tooth-like portions 423. The first and second locking sites 426,427 are aligned with each other along an axis (L) of symmetry of the guide groove 422. Each of the first and second locking sites 426, 427 is situated on the shoulder surface 425 of one of the inclined tooth-like portions 423.

The locking member 43 is movably mounted to the housing, and has a locking portion 432 that is inserted into the guide groove 422 to move between the first and second locking sites 426, 427. When the locking portion 432 slides along the groove wall 4221 to one of the first and second locking sites 426, 427, the shoulder surface 425 prevents a backward movement of the locking portion 432, so that the locking portion 432 moves only forward to slide along the inclined tooth-like portions 423 one after the other.

In the first embodiment, the locking member 43 further has a pivot portion 431 inserted movably into the elongate opening 421. The pivot portion 431 may pivotally extend through the housing base 1 to the elongate opening 421. In such an arrangement, the pivot portion 431 not only guides the sliding movement of the sliding member 42, but also prevents separation of the locking member 43 from the housing base 1.

In the first embodiment, the retaining plate 44 urges the locking portion 432 to contact against the groove wall 4221 so as to prevent the locking portion 432 of the locking member 43 from being separated from the annular groove 422.

Figure 7:
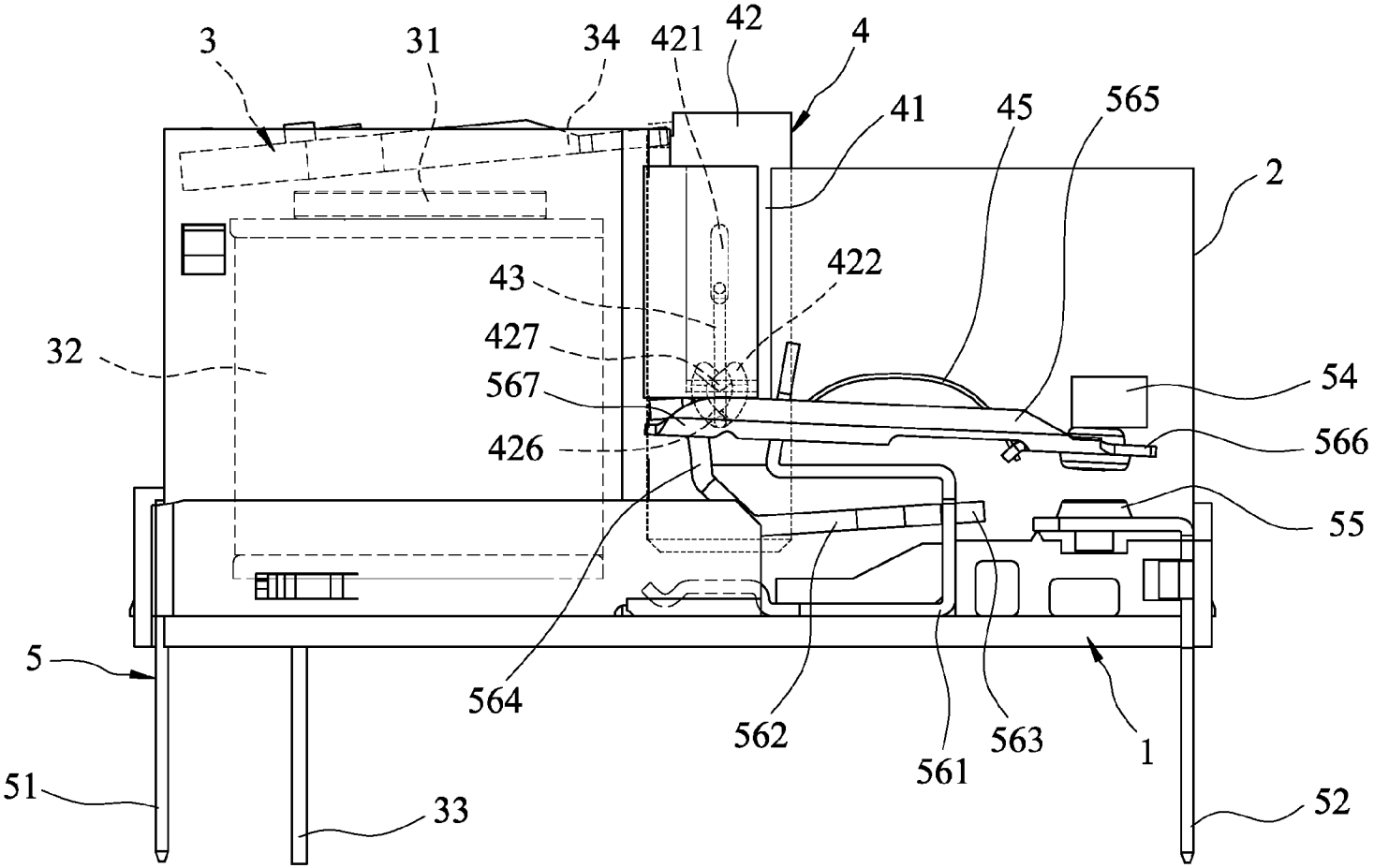
FIG. 7 is a partly sectional front view of the first embodiment illustrating the sliding member in a first position, the locking member in a first locking site, and a passive plate spaced apart from a second conductive plate of a switch assembly of the electromagnetic relay assembly.
Figure 8:
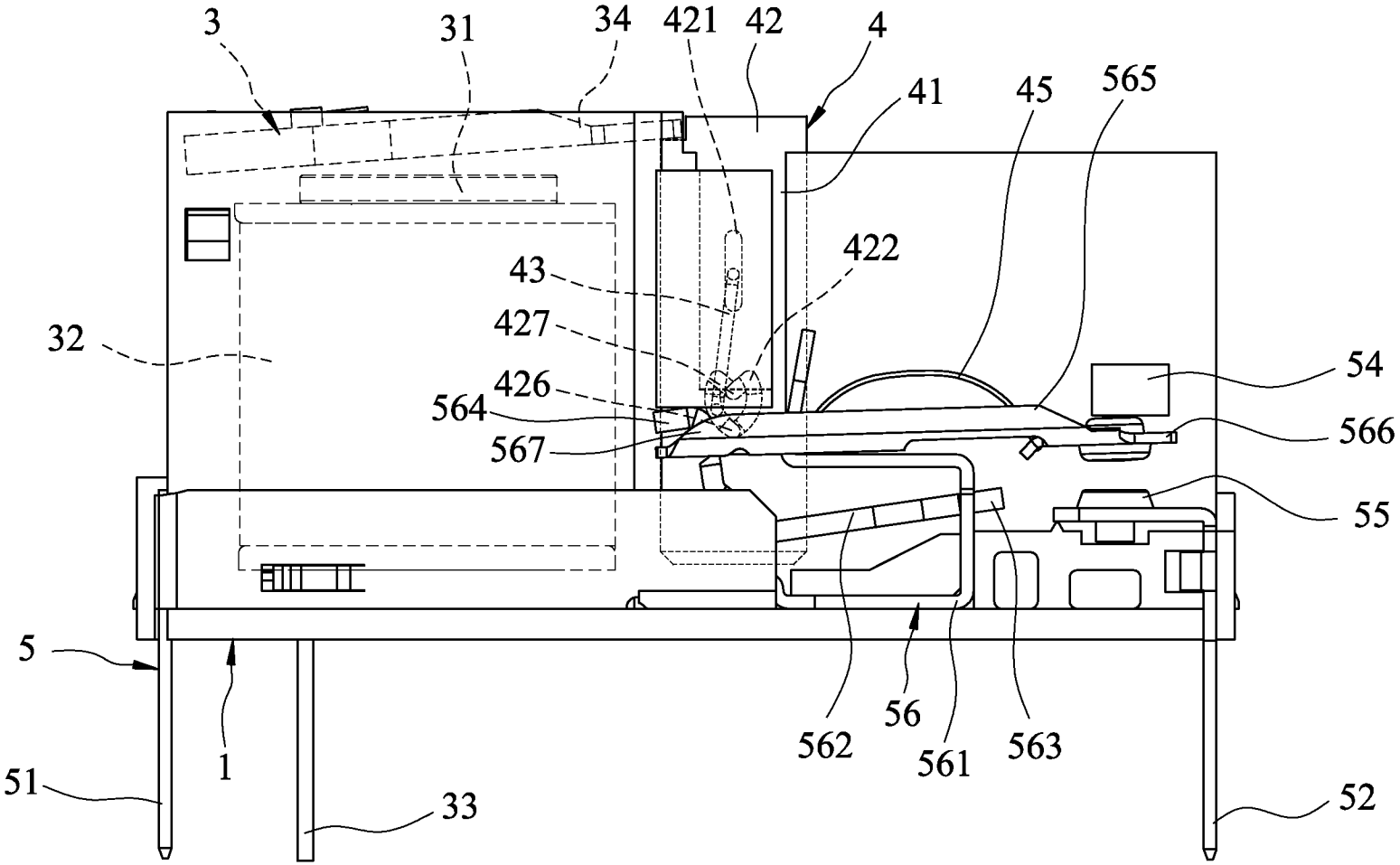
FIG. 8 is a partly sectional front view similar to FIG. 7, illustrating the sliding member moving to a second position and the locking member moving to a second locking site.
Figure 9:
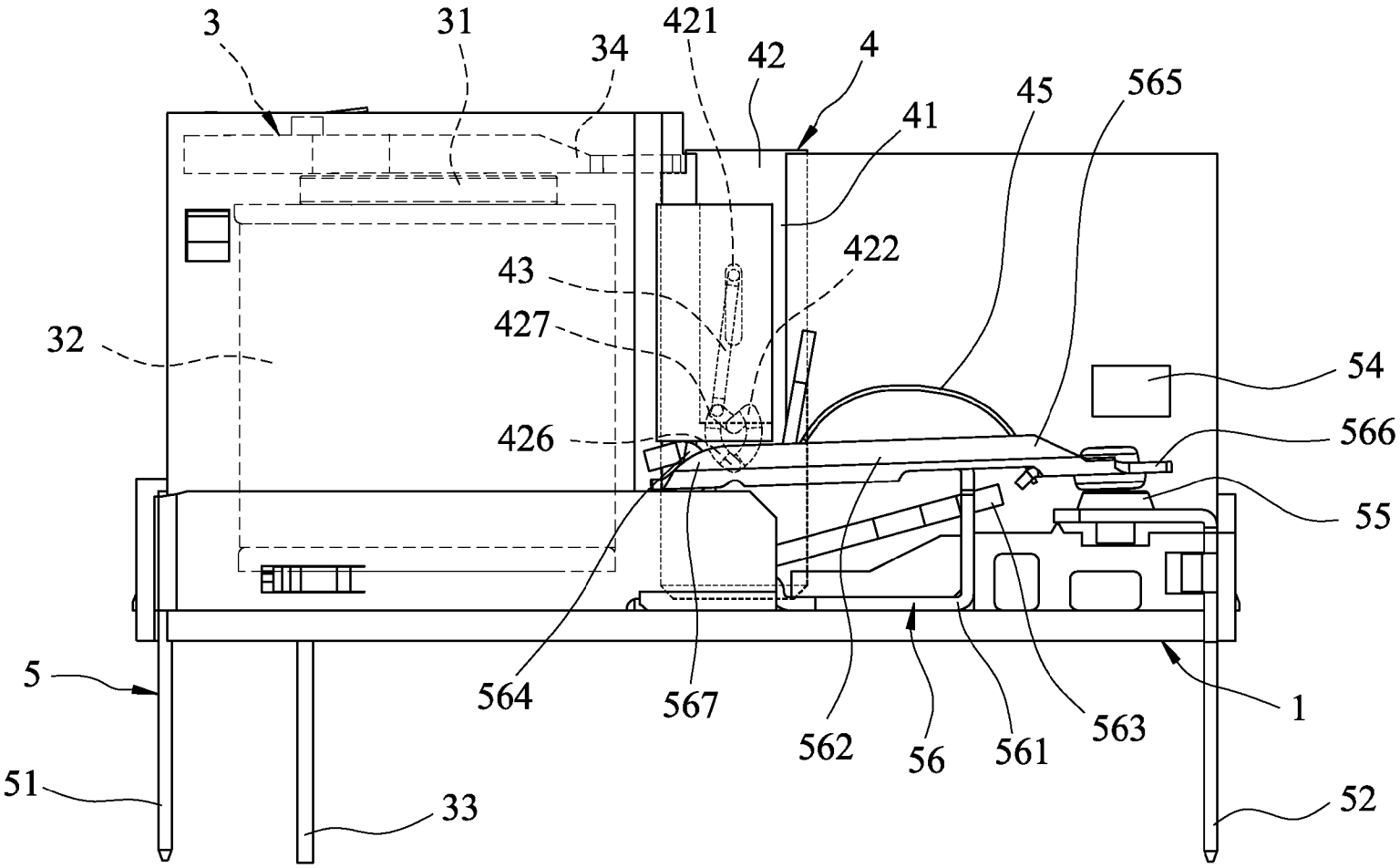
FIG. 9 is a partly sectional front view similar to FIG. 7, illustrating the sliding member continuing to move to the second position, and the locking member continuing to move to the second locking site such that the passive plate is connected to the second conductive plate.
Figure 10:
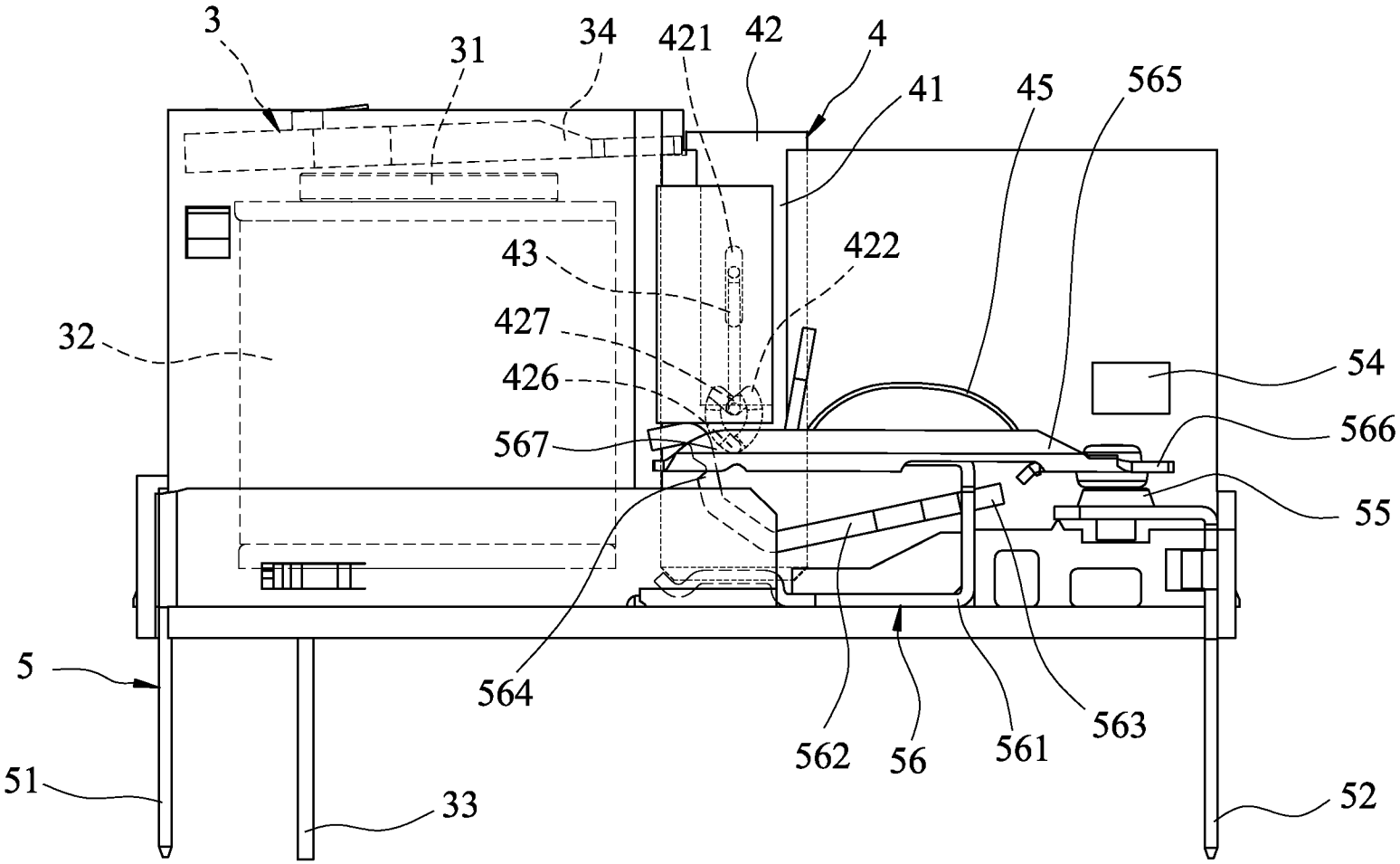
FIG. 10 is a partly sectional front view similar to FIG. 7, illustrating the sliding member being locked in the second position, and the locking member being positioned in the second locking site, such that the passive plate is still connected to the second conductive plate.

When the sliding member 42 is in the first position, the locking portion 432 of the locking member 43 is positioned to the first locking site 426 (as shown in FIG. 7). When the coil 32 is electrified or energized and the magnetic spool 31 is excited to magnetically attract the armature 34, the sliding member 42 is driven by the armature 34 to slide downward along the sliding groove 41 (as shown in FIGS. 8 and 9) and moves to the second position. When the coil 32 is not electrified, the locking portion 432 of the locking member 43 is positioned in the second locking site 427 and the sliding member 42 is locked in the second position (as shown in FIG. 10).

Figure 11:
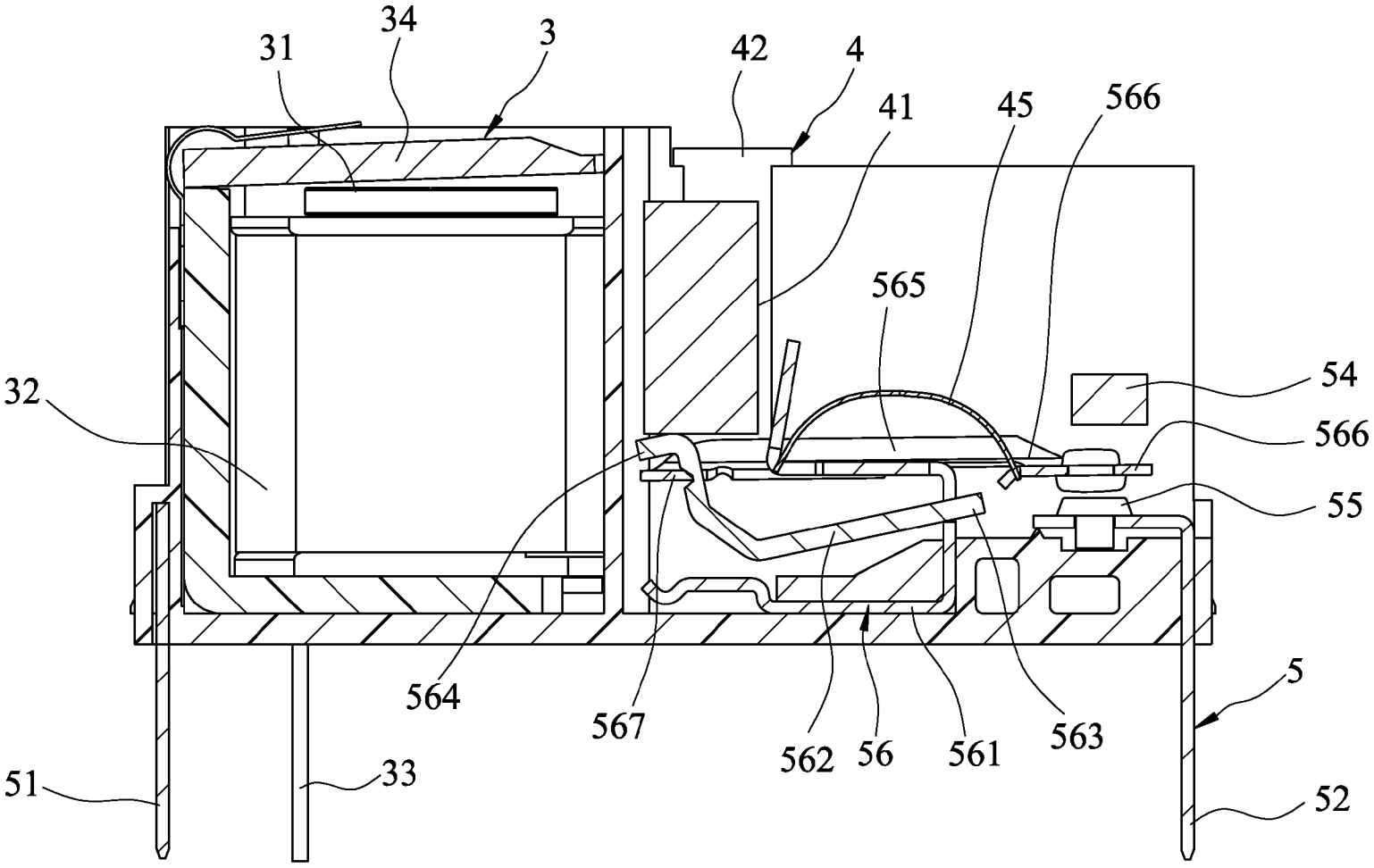
FIG. 11 is a sectional view illustrating the sliding member connected to the switch assembly when the passive plate is still connected to the second conductive plate.

Referring to FIGS. 3, 7 and 11, the switch assembly 5 includes first and second conductive plates 51, 52 mounted to the housing, and a switching unit 56 disposed in the housing to switch the first and second conductive plates 51, 52 between electrically connected and disconnected states. In the first embodiment, the sliding member 42 is connected to the switching unit 56. In addition, the switch assembly 5 further includes a first contact member 54 disposed in the housing, and a second contact member 55 mounted on the second conductive plate 52. In this embodiment, the switch assembly 5 and the electromagnetic unit 3 are electrically isolated from each other. The first and second conductive plates 51, 52 are mounted to the housing base 1 and are spaced apart from each other.

In the first embodiment, the first contact member 54 is mounted to the housing base 1 and is aligned in a spaced-apart manner with the second contact member 55.

The switching unit 56 is connected to the first conductive plate 51, and has a conductive substrate 561, an active plate 562 and a passive plate 565. The conductive substrate 561, the active plate 562 and the passive plate 565 may be made of a metal material so as to enable flow of the electrical current therethrough.

In the first embodiment, the conductive substrate 561 is mounted on the housing base 1 and is connected to the first conductive plate 51.

The active plate 562 is connected between the conductive substrate 561 and the sliding member 42. The active plate 562 has a connection portion 563 pivotally connected to the conductive substrate 561, and a force-transmitting portion 564 in contact with the sliding member 42.

The passive plate 565 is connected to the conductive substrate 561. Preferably, the passive plate 565 is connected to the active plate 562 to make electrical contact with the second conductive plate 52. When the sliding member 42 slides between the first position and the second position, the passive plate 565 is movable relative to the conductive substrate 561. In the first embodiment, the passive plate 565 has a contact portion 566 to connect to the second conductive plate 52, and a force-receiving portion 567 distal from the contact portion 566. The contact portion 566 of the passive plate 565 is connectable to one of the first contact member 54 and the second contact member 55. The force-receiving portion 567 of the passive plate 565 and the force-transmitting portion 564 of the active plate 562 are connected to each other. When the sliding member 42 is in the first position, the contact portion 566 of the passive plate 565 is connected to the first contact member 54. In such a condition, the passive plate 565 is disconnected from the second conductive plate 52, and thus the first conductive plate 51 is not electrically coupled to the second conductive plate 52. When the sliding member 42 is in the second position, the contact portion 566 of the passive plate 565 is connected to the second contact member 54. As a result, the passive plate 565 is connected to the second conductive plate 52, and thus the first conductive plate 51 is electrically coupled to the second conductive plate 52.

In the first embodiment, the switching unit 56 further has a resilient plate 45 connected between the conductive substrate 561 and the passive plate 565. In this embodiment, the resilient plate 45 is a curved plate spring made of a metal material, and is compressed when the resilient plate 45 is assembled between the conductive substrate 561 and the contact portion 566 of the passive plate 565. As a result, when the sliding member 42 is in the first position, the resilient plate 45 pushes upward the passive plate 565 to contact against the first contact member 54. When the sliding member 42 is in the second position, the resilient plate 45 pushes downward the passive plate 565 to contact against the second contact member 55.

Figure 12:
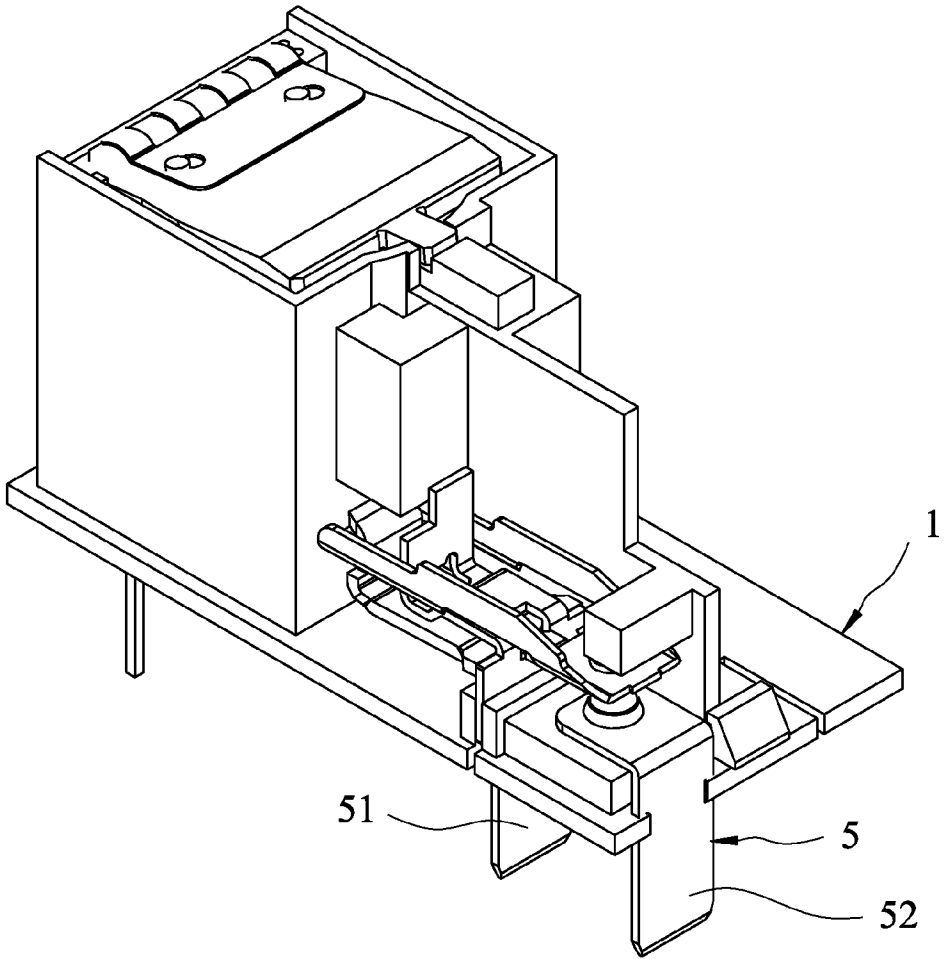
FIG. 12 is a perspective view illustrating the second embodiment of an electromagnetic relay assembly according to the present invention.

FIG. 12 illustrates the second embodiment of an electromagnetic relay assembly according to the present invention, which has a configuration similar to that of the first embodiment. However, in the second embodiment, the first and second conductive plates 51, 52 are aligned with and spaced apart from each other relative to the housing base 1.

Figure 13:
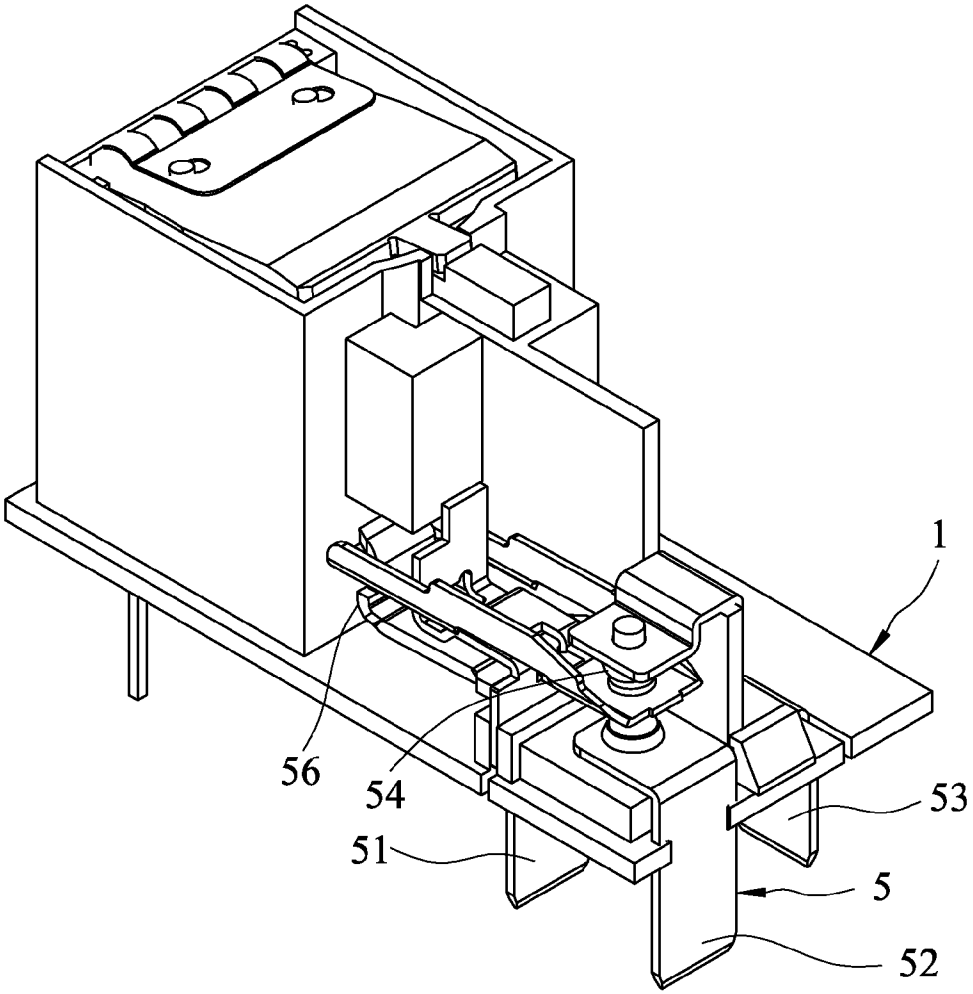
FIG. 13 is a perspective view illustrating the third embodiment of an electromagnetic relay assembly according to the present invention.

FIG. 13 illustrates the third embodiment of an electromagnetic relay assembly according to the present invention, which has a configuration similar to that of the second embodiment. However, in the third embodiment, the switch assembly 5 further includes a third conductive plate 53 disposed at the housing base 1 in the housing. The first contact member 54 is mounted on the third conductive plate 53. When the sliding member 42 is in the first position, the switching unit 56 contacts the first contact member 54, such that the first conductive plate 51 is electrically coupled to the third conductive plate 53. When the sliding member 42 is in the second position, the switching unit 56 contacts the second contact member 55, such that the first conductive plate 51 is electrically coupled to the second conductive plate 52. In the third embodiment, the first conductive plate 51 can serve as a relay common output (COM). The second conductive plate 52 can serve as a relay normally open output (NO). The third conductive plate 53 can serve as a relay normally closed output (NC).

To sum up, the electromagnetic relay assembly according to the present invention provides the following advantages and effects:

1. By virtue of sliding of the locking portion 432 of the locking member 43 in the guide groove 422, the sliding member 42 can be assuredly locked in the first position or in the second position, and the switch assembly 5 can therefore be constantly switched to the electrically connected or disconnected state.

Accordingly, even in a severe vibration environment, the electromagnetic relay according to the present invention is safe to use.

2. By virtue of the resilient member 45, the contact portion 566 of the passive plate 565 can be biased to move between the first contact member 54 and the second contact member 55 and to contact tightly against the first contact member 54 or the second contact member 55 without requiring additional positioning elements, thereby reducing the spatial volume to accommodate assembly components.

3. By virtue of the third conductive plate 53 in the third embodiment, the electromagnetic relay assembly may have two operating circuits, thereby increasing flexibility during use.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electromagnetic relay assembly comprising:

a housing;

an electromagnetic unit disposed in said housing and including a magnetic spool, a coil wound on said magnetic spool, and an armature pivotally disposed on said magnetic spool;

a switch assembly including first and second conductive plates mounted to said housing, and a switching unit disposed in said housing to switch said first and second conductive plates between electrically connected and disconnected states; and a switch control unit disposed between said switching unit and said armature, and including a sliding member that is slidably disposed in said housing to move between first and second positions, and a locking member, said sliding member being connected to said switching unit and having a guide groove formed with a first locking site and a second locking site, and an elongate opening spaced apart from said guide groove, said locking member being movably mounted to said housing; and having a locking portion that is inserted into said guide groove to move between said first and second locking sites, and a pivot portion inserted movably into said elongate opening;

wherein said guide groove is annular and has a groove wall along which said locking portion slides, said groove wall being formed with a plurality of inclined tooth-like portions that are arranged annularly, each of said inclined tooth-like portions having a slanting surface and a shoulder surface adjoining said slanting surface of an adjacent one of said inclined tooth-like portions, each of said first and second locking sites being situated on said shoulder surface of one of said inclined tooth-like portions;

wherein said switch control unit further includes a retaining plate that urges said locking portion to contact against said groove wall;

wherein said switching unit provides a resilient force to push said sliding member to the first position and to place said locking portion in said first locking site such that said sliding member is locked in the first position where said switching unit switches said first and second conductive plates to the electrically disconnected state; and wherein, when said coil is energized, said sliding member is moved by said armature to the second position, and said locking portion is placed in said second locking site such that said sliding member is locked in the second position where said switching unit is actuated by said sliding member to switch said first and second conductive plates to the electrically connected state.

2. The electromagnetic relay assembly as claimed in claim 1, wherein said guide groove has an outer profile substantially conforming to a heart shape, said first and second locking sites being aligned with each other along an axis of symmetry of said guide groove.

3. The electromagnetic relay assembly as claimed in claim 1, wherein:

said switch assembly further includes a first contact member disposed in said housing, and a second contact member mounted on said second conductive plate;

said switching unit is connected to said first conductive plate;

when said sliding member is in the first position, said switching unit contacts said first contact member and is disconnected from said second contact member, such that said first conductive plate and said second conductive plate are disconnected from each other; and when said sliding member is in the second position, said switching unit contacts said second contact member, such that said first conductive plate is electrically coupled to said second conductive plate by said connection member.

4. The electromagnetic relay assembly as claimed in claim 3, wherein said switch assembly further includes a third conductive plate disposed in said housing, said first contact member being mounted on said third conductive plate, when said sliding member is in the first position, said switching unit contacts said first contact member, such that said first conductive plate is electrically coupled to said third conductive plate, and when said sliding member is in the second position, said switching unit contacts said second contact member, such that said first conductive plate is electrically coupled to said second conductive plate.

5. An electromagnetic relay assembly comprising:

a housing;

an electromagnetic unit disposed in said housing and including a magnetic spool, a coil wound on said magnetic spool, and an armature pivotally disposed on said magnetic spool;

a switch assembly including first and second conductive plates mounted to said housing, and a switching unit disposed in said housing to switch said first and second conductive plates between electrically connected and disconnected states, said switching unit having conductive substrate mounted to said housing and connected to said first conductive plate, and a passive plate connected to said conductive substrate; and a switch control unit disposed between said switching unit and said armature, and including a sliding member that is slidably disposed in said housing to move tween first and second positions, and a locking member, said sliding member being connected to said switching unit having a guide groove formed with a first locking site and a second locking site, said locking member being movably mounted to said housing, and having a locking portion that is inserted into said guide groove to move between said first and second locking sites;

wherein said passive plate has a contact portion to connect to said second conductive plate, and a force-receiving portion distal from said contact portion, said switching unit further having an active plate that has a connection portion connected to said conductive substrate, and a force-transmitting portion connected to said force-receiving portion of said passive plate;

wherein said switching unit provides a resilient force to push said sliding member to the first position and to place said locking portion in said first locking site such that said sliding member is locked in the first position where said switching unit switches said first and second conductive plates to the electrically disconnected state;

wherein, when said coil is energized, said sliding member is moved by said armature to the second position, and said locking portion is placed in said second locking site such that said sliding member is locked in the second position where said switching unit is actuated by said sliding member to switch said first and second conductive plates to the electrically connected state;

wherein, when said sliding member is in the first position, said passive plate is disconnected from said second conductive plate, such that said first conductive plate is not electrically coupled to said second conductive plate; and wherein, when said sliding member is in the second position, said passive plate is connected to said second conductive plate, such that said first conductive plate is electrically coupled to said second conductive plate.

6. An electromagnetic relay assembly comprising:

a housing;

an electromagnetic unit disposed in said housing and including a magnetic spool, a coil wound on said magnetic spool, and an armature pivotally disposed on said magnetic spool;

a switch assembly including first and second conductive plates mounted to said housing, and a switching unit disposed in said housing to switch said first and second conductive plates between electrically connected and disconnected states, said switching unit having a conductive substrate mounted to said housing and connected to said first conductive plate, a passive plate connected to said conductive substrate, and a resilient plate connected between said conductive substrate and said passive plate; and a switch control unit disposed between said switching unit and said armature, and including a sliding member that is slidably disposed in said housing to move between first and second positions, and a locking member, said sliding member being connected to said switching unit and having a guide groove formed with a first locking site and a second locking site, said locking member being movably mounted to said housing, and having a locking portion that is inserted into said guide groove to move between said first and second locking sites;

wherein said switching unit provides a resilient force to push said sliding member to the first position and to place said locking portion in said first locking site such that said sliding member is locked in the first position where said switching unit switches said first and second conductive plates to the electrically disconnected state;

wherein, when said coil is energized, said sliding member is moved by said armature to the second position, and said locking portion is placed in said second locking site such that said sliding member is locked in the second position where said switching unit is actuated by said sliding member to switch said first and second conductive plates to the electrically connected state;

wherein, when said sliding member is in the first position, said passive plate is disconnected from said second conductive plate, such that said first conductive plate is not electrically coupled to said second conductive plate; and wherein, when said sliding member is in the second position, said passive plate is connected to said second conductive plate, such that said first conductive plate is electrically coupled to said second conductive plate.

7. An electromagnetic relay assembly comprising:

a housing;

an electromagnetic unit disposed in said housing and including a magnetic spool, a coil wound on said magnetic spool, and an armature pivotally disposed on said magnetic spool;

a switch assembly including first and second conductive plates mounted to said housing, and a switching unit disposed in said housing to switch said first and second conductive plates between electrically connected and disconnected states; and a switch control unit disposed between said switching unit and said armature, and including a sliding member that is slidably disposed in said housing to move between first and second positions, and a locking member, said sliding member being connected to said switching unit and having a guide groove formed with a first locking site and a second locking site, said locking member being movably mounted to said housing, and having a locking portion that is inserted into said guide groove to move between said first and second locking sites;

wherein said switching unit has a conductive substrate mounted to said housing and connected to said first conductive plate, an active plate connected between said conductive substrate and said sliding member, and a passive plate connected to said active plate to make electrical contact with said second conductive plate, said active plate having a force-transmitting portion in contact with said sliding member, said active plate being resilient such that said force-transmitting portion of said active plate is biased to push said sliding member to the first position;

wherein said switching unit provides a resilient force to push said sliding member to the first position and to place said locking portion in said first locking site such that said sliding member is locked in the first position where said switching unit switches said first and second conductive plates to the electrically disconnected state; and wherein, when said coil is energized, said sliding member is moved by said armature to the second position, and said locking portion is placed in said second locking site such that said sliding member is locked in the second position where said switching unit is actuated by said sliding member to switch said first and second conductive plates to the electrically connected state.

8. The electromagnetic relay assembly as claimed in claim 7, wherein said switching unit further has a resilient plate, said active plate further having a connection portion pivotally connected to said conductive substrate, said passive plate having a force-receiving portion connected to said force-transmitting portion of said active plate, and a contact portion, said resilient plate being connected between said conductive substrate and said contact portion of said passive plate.

* * * * *